US009735499B2

(12) United States Patent
Pachon et al.

(10) Patent No.: US 9,735,499 B2
(45) Date of Patent: Aug. 15, 2017

(54) WIRE HOLDER SUPPORT

(75) Inventors: Arturo Pachon, Badalona (ES); Maria Maqueda Gonzalez, Barcelona (ES)

(73) Assignee: CommScope Connectivity Spain, S.L., Madrid (ES)

( * ) Notice: Subject to any disclaimer, the term of this patent is extended or adjusted under 35 U.S.C. 154(b) by 0 days.

(21) Appl. No.: 14/119,695

(22) PCT Filed: May 17, 2012

(86) PCT No.: PCT/EP2012/059225
§ 371 (c)(1),
(2), (4) Date: Nov. 22, 2013

(87) PCT Pub. No.: WO2012/159976
PCT Pub. Date: Nov. 29, 2012

(65) Prior Publication Data

US 2014/0087583 A1 Mar. 27, 2014

(30) Foreign Application Priority Data

May 24, 2011 (ES) ..... 201130555 U

(51) Int. Cl.
*H01R 13/58* (2006.01)
*H01R 13/6463* (2011.01)
(Continued)

(52) U.S. Cl.
CPC ..... *H01R 13/58* (2013.01); *H01R 13/6463* (2013.01); *H01R 24/64* (2013.01); *H01R 2107/00* (2013.01)

(58) Field of Classification Search
CPC .. G01R 24/64; H01R 13/6463; H01R 13/506; H01R 13/6461; H01R 2201/04;
(Continued)

(56) References Cited

U.S. PATENT DOCUMENTS 6,193,542 B1 2/2001 Marowsky et al.
6,227,899 B1 5/2001 Bogese, II
(Continued)

FOREIGN PATENT DOCUMENTS

CN 1131828 9/1996
EP 0 716 477 6/1996
(Continued)

OTHER PUBLICATIONS

International Search Report for International Application No. PCT/EP2012/059225 mailed Aug. 17, 2012 (2 pages).

*Primary Examiner* — Renee Luebke
*Assistant Examiner* — Paul Baillargeon
(74) *Attorney, Agent, or Firm* — Merchant & Gould P.C.

(57) ABSTRACT

A wire holder (4) for a modular communications connector includes insertion cavities (21, 22, 25) positioned for receiving a set of twisted conductor pairs so that each conductor pair can be inserted in an insertion cavity and/or two conductor pairs can be inserted in a same insertion cavity, depending on the communications cable type, its constructive features, the type of application, such that it provides a better performance, such as for data communications cables for high data rates. The wire holder (4) distributes the set of insertion cavities (21, 22, 25) in more than two planes, such that a first plane comprises two insertion cavities (21) that each accept one pair of conductors, a second plane comprises an insertion cavity (25) that accepts one pair of conductors and a third plane includes an insertion cavity (22) that accepts more than one pair of conductors.

20 Claims, 8 Drawing Sheets

(51) Int. Cl.
*H01R 24/64* (2011.01)
*H01R 107/00* (2006.01)

(58) Field of Classification Search
CPC ..... H01R 4/242; H01R 13/58; H01R 24/64; Y10S 439/941
USPC .... 439/676, 620.11, 620.17, 620.18, 620.23, 439/460
See application file for complete search history.

(56) References Cited

U.S. PATENT DOCUMENTS

| | | | | |
|---|---|---|---|---|
| 6,250,949 | B1 | 6/2001 | Lin | |
| 6,319,048 | B1 | 11/2001 | Aekins et al. | |
| 6,375,491 | B1 | 4/2002 | Durand et al. | |
| 6,379,175 | B1 | 4/2002 | Reede | |
| 6,402,559 | B1 | 6/2002 | Marowsky et al. | |
| 6,406,325 | B1 | 6/2002 | Chen | |
| 6,558,204 | B1 | 5/2003 | Weatherley | |
| 6,561,838 | B1 | 5/2003 | Blichfeldt | |
| 6,783,402 | B2 * | 8/2004 | Chen | 439/676 |
| 7,175,468 | B1 * | 2/2007 | Chang | H01R 13/6463 439/418 |
| 7,220,149 | B2 | 5/2007 | Pharney | |
| 7,722,410 | B2 | 5/2010 | De Dios Martin et al. | |
| 8,348,702 | B2 * | 1/2013 | Lin | 439/676 |
| 2002/0048990 | A1 | 4/2002 | Marowsky | |
| 2002/0142644 | A1 | 10/2002 | Aekins | |

FOREIGN PATENT DOCUMENTS

| | | |
|---|---|---|
| EP | 1 248 329 | 10/2002 |
| WO | WO 2007/068875 | 6/2007 |

* cited by examiner

FIG. 1
(PriorArt)
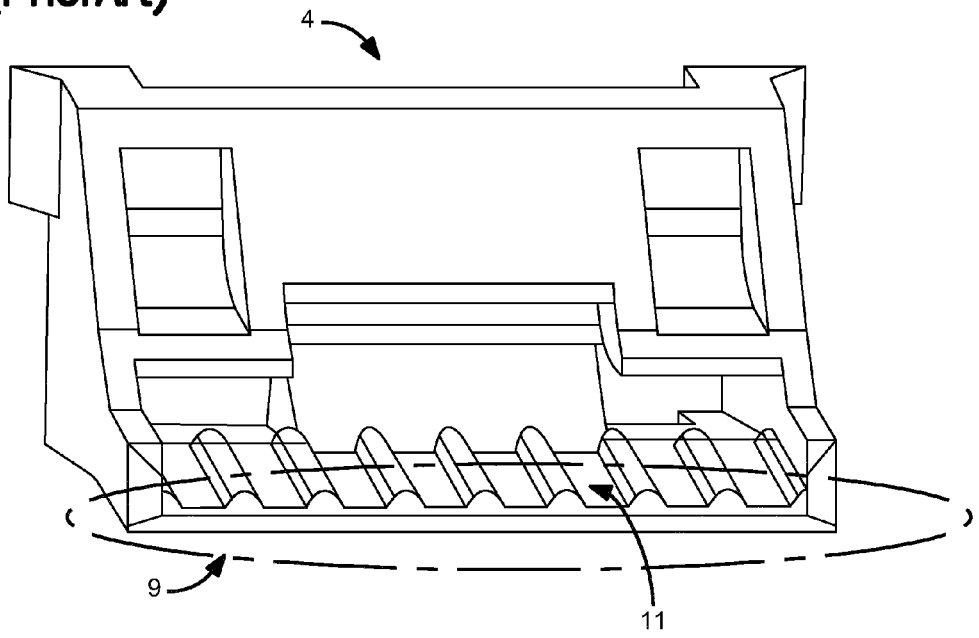
FIG. 2
(PriorArt)
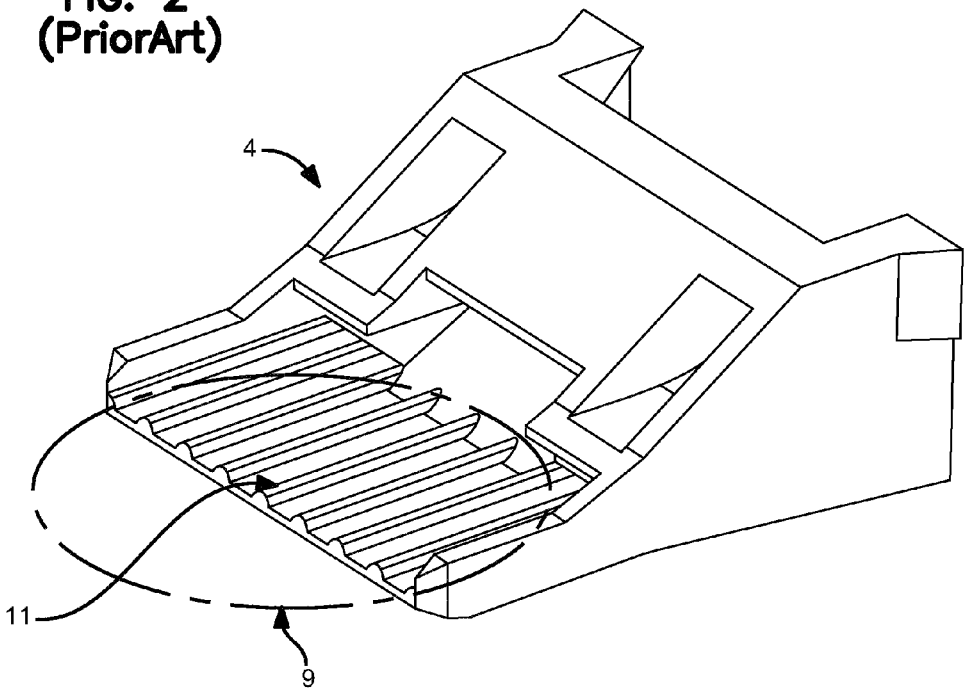

FIG. 3
(PriorArt)
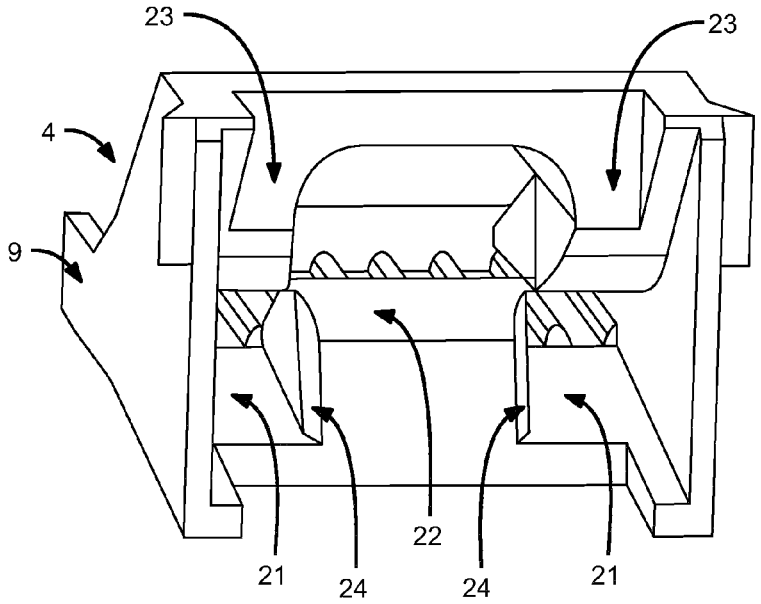

WIRE HOLDER SUPPORT

This application is a National Stage Application of PCT/EP2012/059225, filed 17 May 2021, which claims benefit of Ser. No. 02/011,30555, filed 24 May 2011 in Spain and which applications are incorporated herein by reference. To the extent appropriate, a claim of priority is made to each of the above disclosed applications.

FIELD OF THE INVENTION

The present invention relates, in general, to a connector for terminating a data communications cable used for high rate data.

STATE OF THE ART

A modular communication connector of the prior art is known from European Patent Application EP 1961078 A1, for terminating a cable comprising twisted pairs of insulated conductors surrounded by a cable insulation layer, specifically designed for use in high data rates, such as in local area networks (LAN).

Due to continuously increasing data rates and the short distance between the adjacent conductors placed in the modular connector, excessive diaphony limits the capacity of the existing modular connectors for high data rates.

The cables connected to the modular connectors comprise twisted pairs of insulated conductors, sometimes surrounded by a conductor shielding layer that is in turn surrounded by the cable insulation. Twisting the conductor pairs considerably reduces their sensitivity to diaphony and allows high data rates. The external shielding reduces the transmission and reception of electromagnetic noise.

One of the problems existing in modular connectors of this type is that in order to join a twisted pair cable to a male modular connector, it is necessary to straighten the end parts of the connectors introduced in insertion cavities and housed in conductor housing grooves of a wire holder included in the male modular connector box. The conductors housed in the housing grooves are connected to contacts that pierce the conductor insulation.

FIGS. 7 to 9 of the aforementioned prior art, included as reference, show the wire holder as seen from the holder contact face, from the admission face and in an isometric perspective view. The wire holder has insertion cavities that cross it from a conductor admission face to a contact face and adjacent housing grooves used to place the ends of the wires in said wire holder and then cut these ends to the exact measure, the wire holder thereby being inserted in the male modular connector.

The holder simplifies the operation to place the wires in the correct order and ensures that the correct order is maintained when the adaptor is introduced in the male modular connector to establish connection with the contacts.

The conductors enter the wire holder through the insertion cavities distributed in two planes, so that there are two insertion cavities that admit only one pair of conductors and one insertion cavity that admits more than one pair of conductors. The insertion cavities comprise displacement surfaces meant to direct each conductor of the pair inserted in the corresponding insertion cavity towards a conductor housing groove, these surfaces being meant to position and maintain the conductors in an adjacent alignment for connecting them to the insulation piercing contacts.

The insertion cavities accepting only one pair of conductors are on the same plane but are not adjacent to each other; that is, they are separated by the insertion cavity that admits more than one pair of conductors and is placed on a different plane above that which contains the insertion cavities for one pair of conductors.

One of the problems with this modular connector is that the arrangement of the untwisted pairs may not be compatible with all the cable types that exist in the market in order to obtain a specific operation in local area network (LAN) applications. This incompatibility will depend on the cable construction and its frequency performance.

SUMMARY

The present invention intends to solve or reduce one or more the drawbacks described above by a wire holder that cooperates with a connector casing box to terminate a data communications cable.

One object of an embodiment of the wire holder that comprises a insertion cavities set for receiving a set of twisted conductor pairs so that each conductor pair can be inserted in an insertion cavity and/or two conductor pairs can be inserted in a same insertion cavity, depending on the communications cable type, its constructive features, the type of application, such that it provides a better performance than a currently existing wire holder with the same data communications cable for high data rates.

Another object of the wire holder is to distribute the set of insertion cavities in more than two planes, such that a first plane comprises two insertion cavities that each accept one pair of conductors, a second plane comprises an insertion cavity that accepts one pair of conductors and a third plane includes an insertion cavity that accepts more than one pair of conductors.

BRIEF DESCRIPTION OF THE DRAWINGS

A more detailed description of the device according to the embodiments of the invention is provided in the following description, made with reference to the accompanying figures, where:

FIGS. 1 to 3 correspond respectively to FIGS. 7 to 9 of the European Patent Application EP 1961078 A1, which represents the state of the art;

EMBODIMENTS OF THE INVENTION

Figure 4:
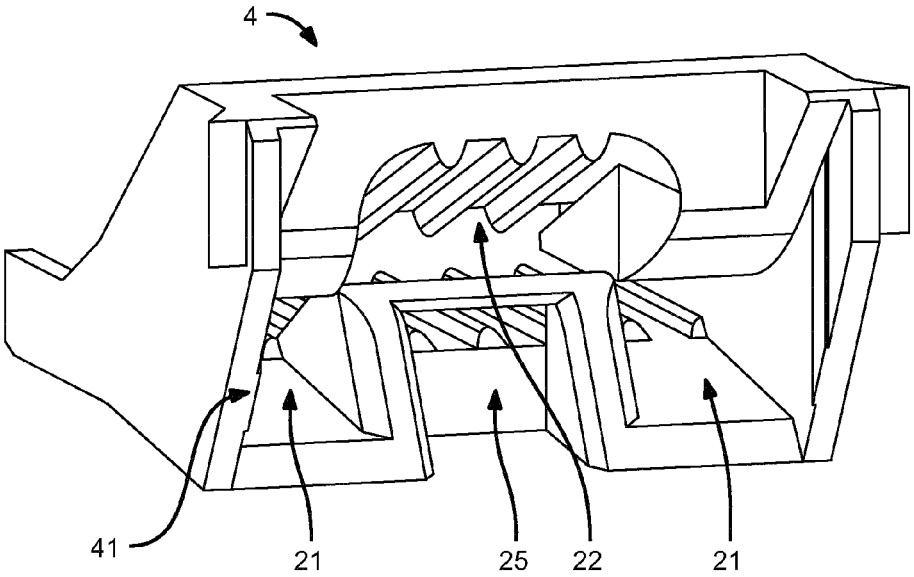
FIG. 4 shows an isometric view of a wire holder that can be mounted inside a housing cavity made in a box of modular connector for terminating a data communications cable.
Figure 5:
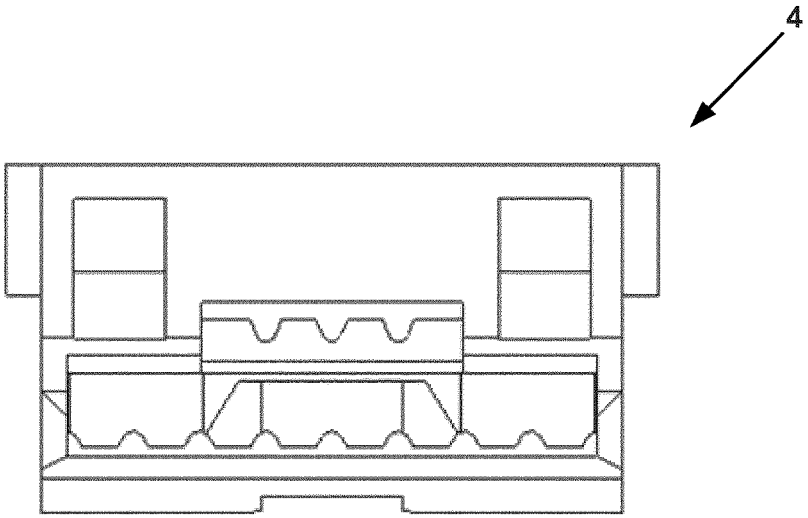
FIG. 5 is a front view of the wire holder.
Figure 6:
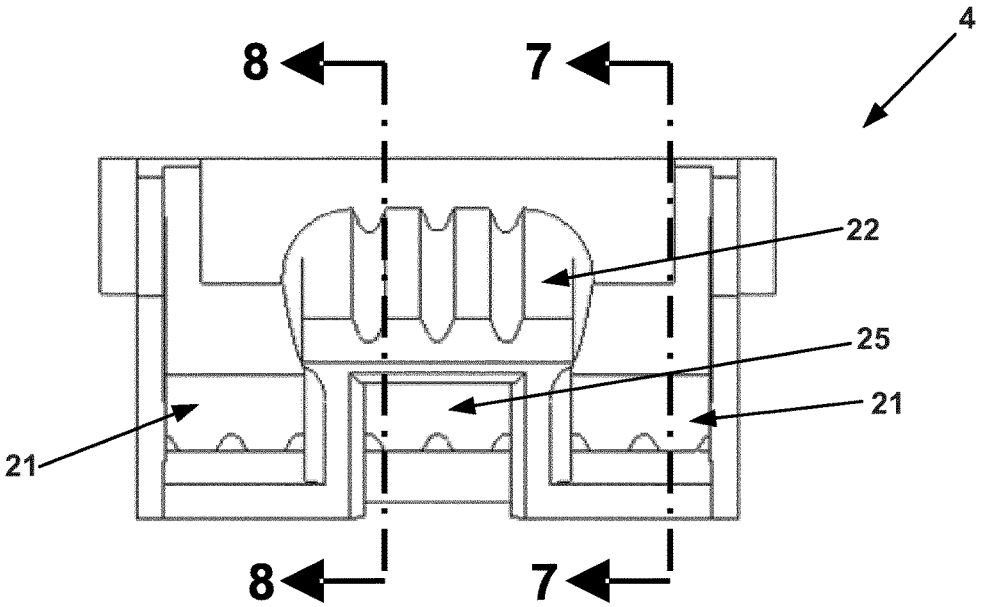
FIG. 6 is a rear view of the wire holder.
Figure 7:
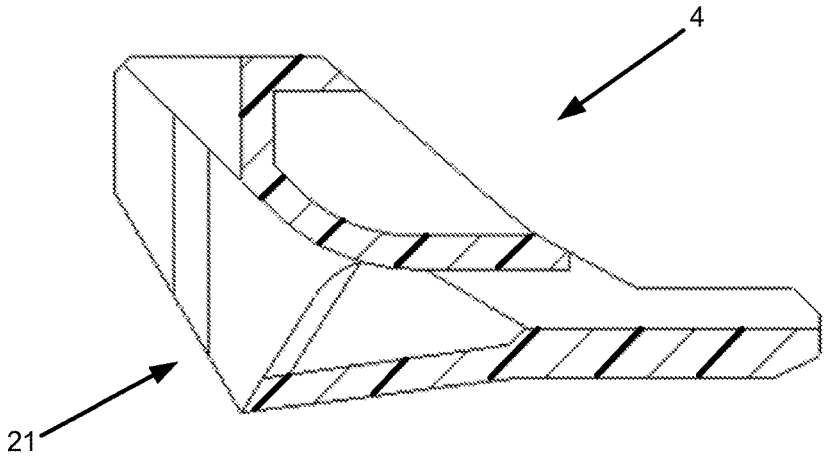
FIG. 7 is a cross-sectional view of the wire holder taken along lines 7-7 of FIG. 6.
Figure 8:
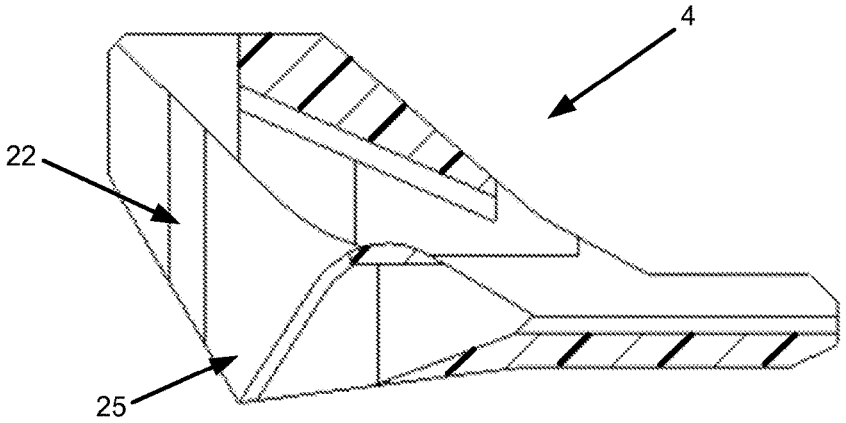
FIG. 8 is a cross-sectional view of the wire holder taken along lines 8-8 of FIG. 6.
Figure 9:
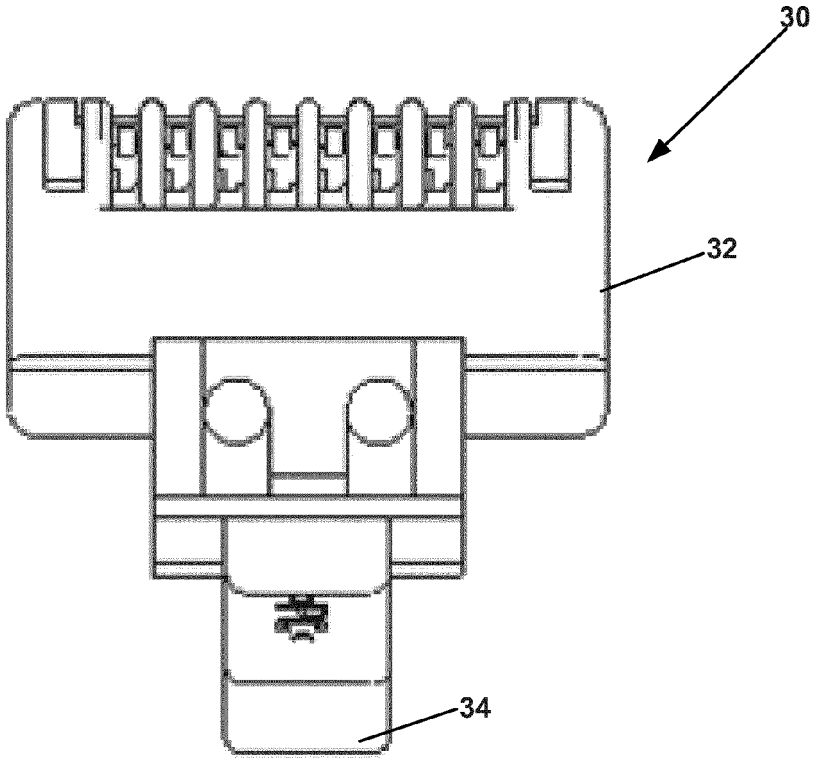
FIG. 9 is a front view of a modular connector including a wire holder.
Figure 10:
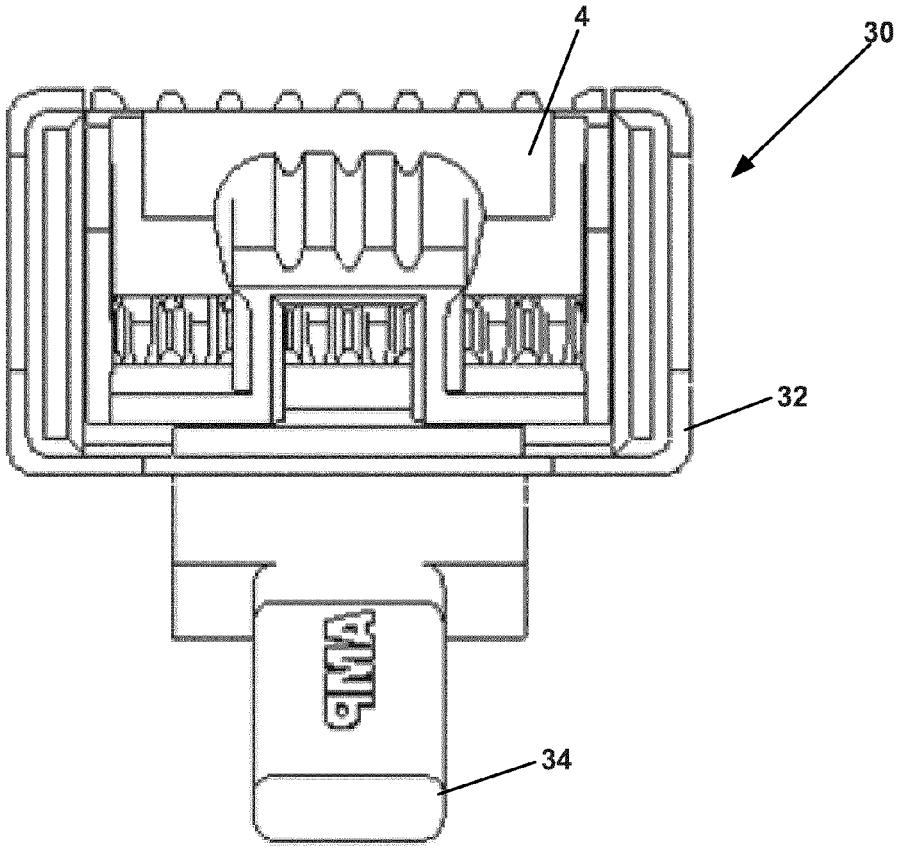
FIG. 10 is a rear view of the modular connector.
Figure 11:
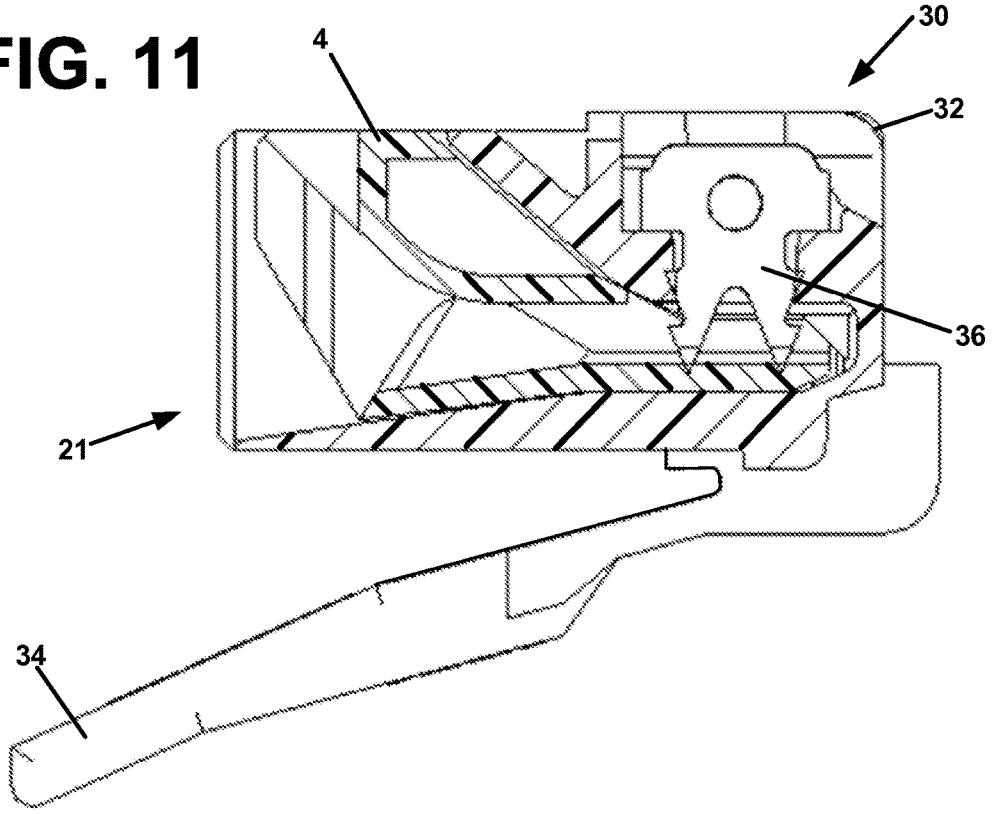
FIG. 11 is a cross-sectional side view of the modular connector with a similar cross-section as shown in FIG. 7.

With reference to FIG. 4, an embodiment is shown of the wire holder 4 that can be inserted in a housing cavity of a modular connector to terminate a data communications cable.

The wire holder 4 comprises a wire holder casing 41 having a face for admitting the twisted conductor pairs that make up the communications cable, and an external contact face that can be inserted in the housing cavity of the modular connector.

Extending from the admission face to the contact face is a set of through insertion cavities 21, 22, 25 that cooperate with a set of conductor housing grooves that extend from the end of the insertion cavities 21, 22, 25 to the external contact face, meant to distribute and maintain the conductors of the twisted pair cable in a predefined order, being untwisted only for the length of the wire holder casing 41 along an insertion axis.

The length of the housing grooves, that is, the distance between the end of the admission cavities and the contact face, is such that it allows placing under it the ends of the contacts provided to pierce the insulation of the ends of the conductors of the twisted pair cable.

Looking at the contact face of the wire holder 4 from the front, the housing grooves describe a curved wavy line such that each conductor of the twisted pair cable is housed in a concave or depressed part of the curved wavy line. That is, the curved wavy line has a succession of adjacent concave parts corresponding to the total number of conductors of the twisted pair cable.

The wire holder 4 comprises a number of insertion cavities 21, 22, 25 equal to the number of twisted pairs that make up the data communications cable, which are suitable for receiving and rerouting each end of a cable of the twisted pair conductor to the corresponding conductor housing groove, when the ends of the conductors are inserted in the admission cavities.

Each admission cavity 21, 22, 25 comprises corresponding displacement surfaces for rerouting the ends of the cables of the twisted pair cable introduced in the cavity towards predetermined housing grooves that cooperate with the aforementioned cavity in maintaining the cables in a predetermined order.

Depending on the type of cable that must be terminated with the modular connector, and to achieve the required performance, the wire holder 4 comprises admission cavities 21, 22, 25 that admit a different number of twisted pairs, that is, the admission cavities 21, 25 in which only one twisted pair of the communications cable can be inserted are distributed on planes near the lower surface of the casing of the wire holder 4, and the admission cavity 22 that admits one or two pairs of twisted pairs of the cable can be located near the upper face of the casing of the wire holder 4.

The admission cavities 21, 25 that admit exclusively one twisted pair of the cable are distributed on two planes, a lower plane and an intermediate plane between the lower plane and the upper plane.

In the intermediate plane are disposed two admission cavities 21, 25, each of them for one twisted pair of the cable, not adjacent to each other; that is, the admission cavity 25 located in the bottom plane separates the two admission cavities 21 of the intermediate plane, so that the top surface of the admission cavity 25 located in the bottom plane forms part of the lower surface of the admission cavity 22 located on the upper plane.

In any case, the conductors of a twisted pair of the cable are surrounded by walls of the corresponding admission cavity 21, 22, 25 in which the conductors of the twisted pair cable are inserted.

Due to the twisted pair cable maintains the cable pairs twisted until they reach the admission face of the wire holder 4. Therefore, the straightened parts of the conductor ends have a minimum length, the maximum distance within the wire holder 4, resulting in a controlled diaphony. In addition, as the ends of the conductors are cut to the exact measure in the final position with respect to the wire holder 4, and the wire holder 4 does not move with respect to the ends of the conductors when these are inserted in the male connector box, the risk is prevented of a conductor being pushed or curved backward when inserted in the cavity of the male connector box, thereby ensuring that all conductors are correctly and reliably connected with their corresponding contacts.

An additional advantage is that, once the wire holder 4 has been joined to the ends of the conductors, the ends of the conductors will be in their final position, and their arrangement can be visually verified clearly before introducing it in the cavity of the male connector box, so that the order cannot be modified due to the position of the ends of the wires in the admission cavities 21, 22, 25 and the housing grooves, as there is no additional movement during the introduction and the connection with the conductors.

A further advantage is that the conductors of the twisted pair cable are inserted fully untwisted in the admission cavities 21, 22, 25. In this way, the diaphony between the different conductors is controlled, thereby ensuring a reliable connection with small tolerances and an improved high data rates capacity.

Figure 12:
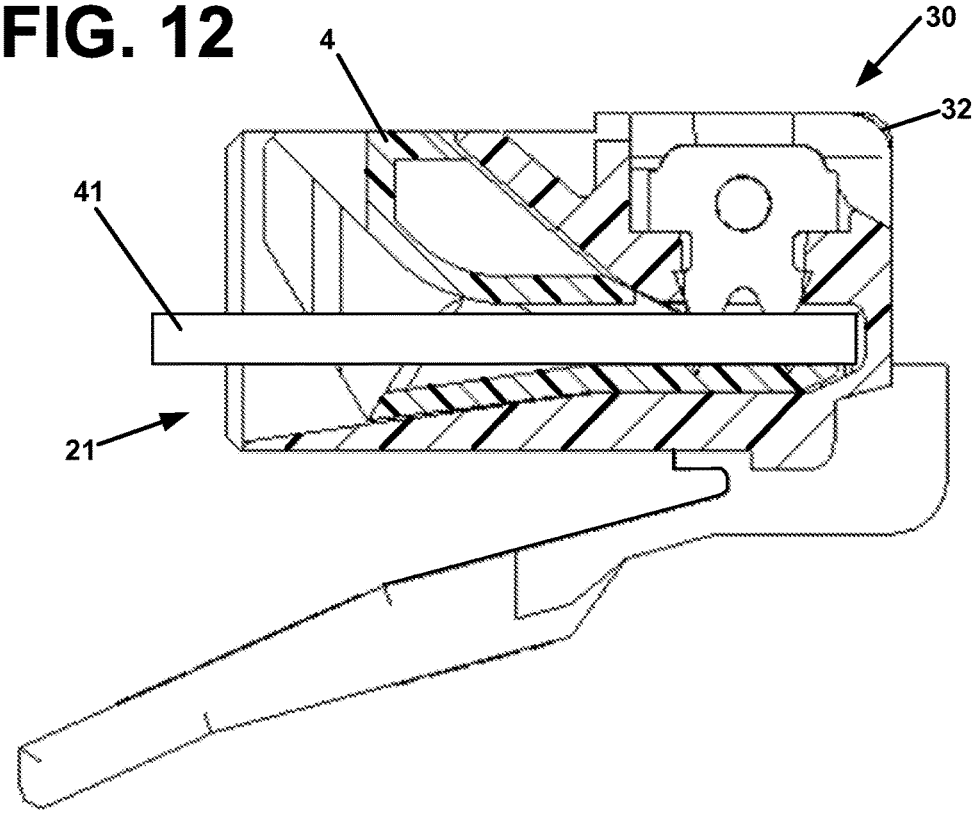
FIG. 12 is the cross-sectional side view of FIG. 11, including an example wire pair shown in one of the cavities.
Figure 13:
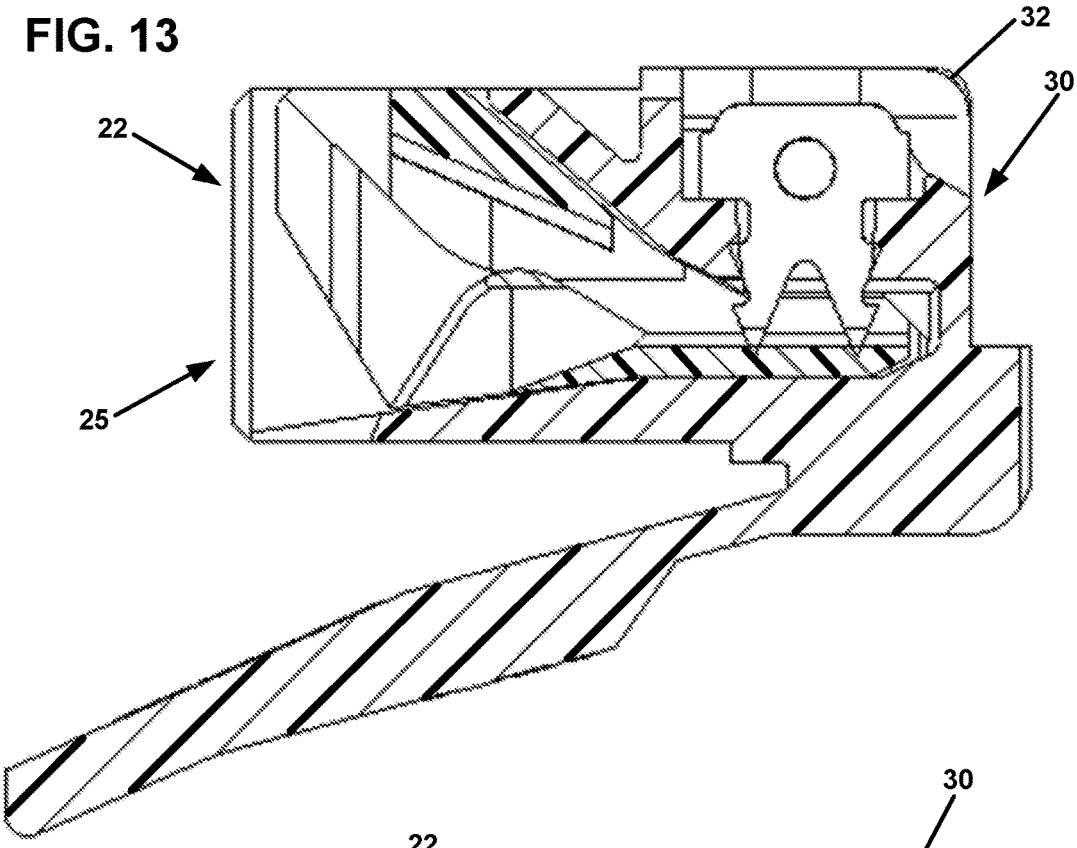
FIG. 13 is a cross-sectional side view of the modular connector similar to the cross-sectional view of FIG. 8.
Figure 14:
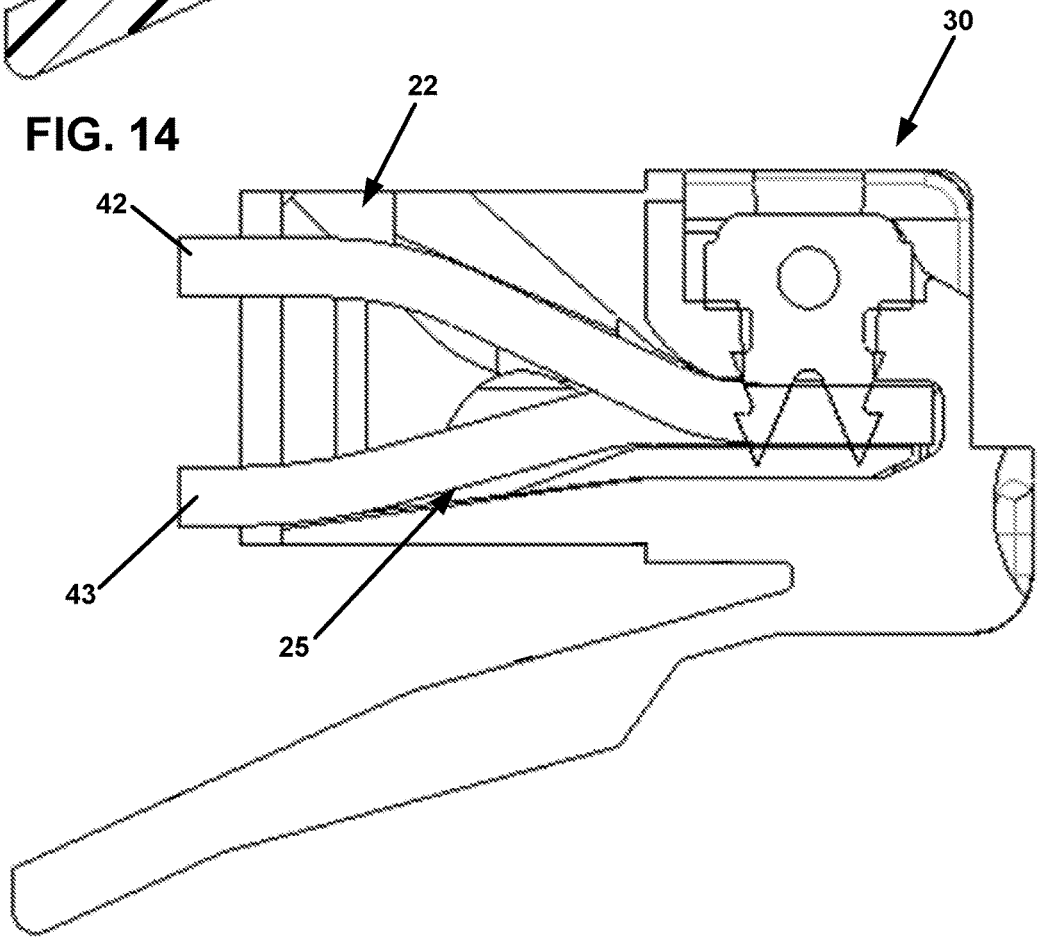
FIG. 14 shows two wire pairs, one wire pair in one cavity, and another wire pair in a different cavity.
Figure 15:
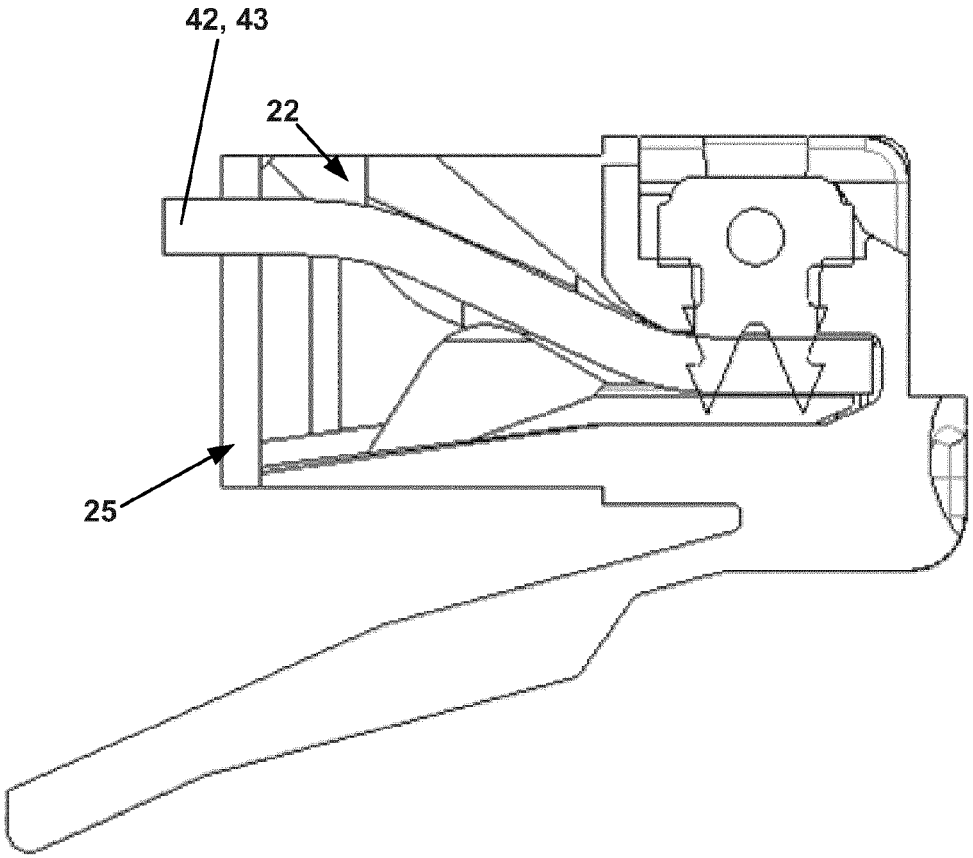
FIG. 15 is a view similar to FIG. 14, showing two wire pairs in the same cavity.

FIGS. 5-15 show the wire holder 4 mounted in a modular communication connector or plug 30. Wire holder 4 is received in connector body 32. Connector body 32 includes a latch 34. Connector body 32 includes a contact element 36 for each wire for making electrical contact between the wire, and the mating jack. As shown in FIG. 12, a pair of wires 41 is positioned in each cavity 21. As shown in FIG. 14, a pair of wires 42 can be positioned in cavity 22, and a pair of wires 43 can be positioned in cavity 25. Alternatively, as shown in FIG. 15, the wire pairs 42 and 43 can both be positioned in cavity 22.

The invention claimed is:

1. A wire holder that can be inserted in a box of a modular connector to terminate a twisted pair cable for data communication, wherein the wire holder comprises a wire holder casing and a flat base portion, the flat base portion extending from the wire holder casing and having an external contact face at a distal end of the twisted pair cable, and the wire holder casing having an admission face for conductors of the twisted pair cable;

wherein the wire holder casing includes four through admission cavities defined by surrounding walls and extending from the admission face toward the external contact face, wherein the flat base portion is integral with the wire holder casing and includes a set of conductor housing grooves extending from an end of the through admission cavities to the external contact face and configured to cooperate with the through admission cavities to support the conductors of the twisted pair cable in a predefined order, wherein the four through admission cavities include a first central admission cavity, a second central admission cavity, and two outside admission cavities, the first central admission cavity arranged between the two outside admission cavities, wherein the first central admission cavity and the two outside admission cavities are arranged to abut with the flat base portion, and the second central admission cavity is arranged above the first central admission cavity and spaced apart from the flat base portion, and wherein the first central admission cavity and the two outside admission cavities are configured to receive only one twisted pair of the cable, respectively, and the second central admission cavity has a width wider than a width of the first central admission cavity throughout the wire holder casing and is configured to receive one or two twisted pairs of the cable.

2. The wire holder according to claim 1, wherein the conductors of the twisted pair cable inserted in the admission cavities are displaced by displacement surfaces included within the admission cavities towards the conductor housing grooves.

3. The wire holder according to claim 1, wherein a number of conductors of the twisted pair cable inserted in the admission cavities depends on a cable type of the twisted pair cable, a construction and frequency performance of the twisted pair cable, and expected transmission losses of the twisted pair cable.

4. The wire holder according to claim 1, wherein the conductors of the twisted pair cable inserted in the admission cavities are surrounded by walls that define the corresponding admission cavity in which the conductors are inserted.

5. The wire holder according to claim 1, wherein the conductors of the twisted pair cable are inserted untwisted in the admission cavities.

6. The wire holder according to claim 1, wherein the admission cavities are distributed in three planes from a lower surface of the wire holder casing to an upper surface thereof; a bottom plane near the lower surface comprising the first central admission cavity for conductors of a twisted pair of the twisted pair cable, an intermediate plane including the two outside admission cavities for conductors of a twisted pair of the twisted pair cable respectively, the two outside admission cavities being separated by the first central admission cavity of the lower plane; and an upper plane comprising the second central admission cavity for conductors of one or two twisted pairs of the twisted pair cable.

7. A modular connector for terminating a twisted pair cable for data communication comprising:

a connector body including a plurality of contact elements; and a wire holder mounted to the connector body, wherein the wire holder includes a wire holder casing and a flat base portion, the flat base portion extending from the wire holder casing and having an external contact face at a distal end of the twisted pair cable, and the wire holder casing having an admission face for conductors of the twisted pair cable; wherein the wire holder casing includes four through admission cavities defined by surrounding walls and extending from the admission face toward the external contact face, wherein the flat base portion is integral with the wire holder casing and includes a set of conductor housing grooves extending from an end of the through admission cavities to the external contact face and configured to cooperate with the through admission cavities to support the conductors of the twisted pair cable in a predefined order, wherein the four through admission cavities include a first central admission cavity, a second central admission cavity, and two outside admission cavities, the first central admission cavity arranged between the two outside admission cavities, wherein the first central admission cavity and the two outside admission cavities are arranged to abut with the flat base portion, and the second central admission cavity is arranged above the first central admission cavity and spaced apart from the flat base portion, and wherein the first central admission cavity and the two outside admission cavities are configured to receive only one twisted pair of the cable, respectively, and the second central admission cavity has a width wider than a width of the first central admission cavity throughout the wire holder casing and is configured to receive one or two twisted pairs of the cable.

8. The modular connector according to claim 7, wherein the conductors of the twisted pair cable inserted in the admission cavities are displaced by displacement surfaces included within the admission cavities towards the conductor housing grooves.

9. The modular connector according to claim 8, further comprising the twisted pair cable, the twisted pair cable including four twisted pairs of conductors extending through the wire holder to contact elements.

10. The modular connector according to claim 7, wherein a number of conductors of the twisted pair cable inserted in the admission cavities depends on a cable type of the twisted pair cable, a construction and frequency performance of the twisted pair cable, and expected transmission losses of the twisted pair cable.

11. The modular connector according to claim 10, further comprising the twisted pair cable, the twisted pair cable including four twisted pairs of conductors extending through the wire holder to contact elements.

12. The modular connector according to claim 7, wherein the conductors of the twisted pair cable inserted in the admission cavities are surrounded by walls that define the corresponding admission cavity in which the conductors are inserted.

13. The modular connector according to claim 12, further comprising the twisted pair cable, the twisted pair cable including four twisted pairs of conductors extending through the wire holder to contact elements.

14. The modular connector according to claim 7, wherein the conductors of the twisted pair cable are inserted untwisted in the admission cavities.

15. The modular connector according to claim 14, further comprising the twisted pair cable, the twisted pair cable including four twisted pairs of conductors extending through the wire holder to contact elements.

16. The modular connector according to claim 7, wherein the admission cavities are distributed in three planes from a lower surface of the wire holder casing to an upper surface thereof; a bottom plane near the lower surface comprising the first central admission cavity for the conductors of a twisted pair of the twisted pair cable, an intermediate plane including the two outside admission cavities for the conductors of a twisted pair of the twisted pair cable respectively, the two outside admission cavities being separated by the first central admission cavity of the lower plane; and an upper plane comprising the second central admission cavity for the conductors of one or two twisted pairs of the twisted pair cable.

17. The modular connector according to claim 16, further comprising the twisted pair cable, the twisted pair cable including four twisted pairs of conductors extending through the wire holder to contact elements.

18. The modular connector according to claim 7, further comprising the twisted pair cable, the twisted pair cable including four twisted pairs of conductors extending through the wire holder to contact elements.

19. A wire holder that can be inserted in a box of a modular connector to terminate a twisted pair cable for data communication, wherein the wire holder comprises a wire holder casing and a flat base portion, the flat base portion extending from the wire holder casing and having an external contact face at a distal end of the twisted pair cable, and the wire holder casing having an admission face for conductors of the twisted pair cable;

wherein the wire holder casing includes four through admission cavities defined by surrounding walls and extending from the admission face toward the external contact face, wherein the conductors of the twisted pair cable inserted in the admission cavities are displaced by displacement surfaces included within the admission cavities towards predefined housing grooves that cooperate with the admission cavities to keep the cables in a specified order, wherein the conductors of the twisted pair cable inserted in the admission cavities are surrounded by walls that define the corresponding admission cavity in which the conductors are inserted, wherein the admission cavities are distributed in three planes from a lower surface of the wire holder casing to an upper surface thereof; a bottom plane near the lower surface comprising a first central admission cavity for conductors of a twisted pair of the twisted pair cable, an intermediate plane including two outside admission cavities for conductors of a twisted pair of the twisted pair cable respectively, the two outside admission cavities being separated by the first central admission cavity of the lower plane; and an upper plane comprising a second central admission cavity for conductors of one or two twisted pairs of the twisted pair cable, wherein each of the two outside admission cavities can only accept one twisted pair each of the twisted pair cable, the first central admission cavity can only accept one twisted pair of the twisted pair cable, and the second central admission cavity can accept one or two pairs of the twisted pair cable, wherein the flat base portion is integral with the wire holder casing and includes a set of conductor housing grooves extending from an end of the through admission cavities to the external contact face and configured to cooperate with the through admission cavities to support the conductors of the twisted pair cable in a predefined order, and wherein the first central admission cavity and the two outside admission cavities are arranged to abut with the flat base portion, and the second central admission cavity is arranged above the first central admission cavity and spaced apart from the flat base portion, the second central admission cavity having a width wider than a width of the first central admission cavity throughout the wire holder casing.

20. A modular connector for terminating a twisted pair cable for data communication comprising:

a connector body including a plurality of contact elements; and a wire holder mounted to the connector body, wherein the wire holder includes a wire holder casing and a flat base portion, the flat base portion extending from the wire holder casing and having an external contact face at a distal end of the twisted pair cable, and the wire holder casing having an admission face for conductors of the twisted pair cable; wherein the wire holder casing includes through admission cavities defined by surrounding walls and extending from the admission face toward the external contact face, wherein the conductors of the twisted pair cable inserted in the admission cavities are displaced by displacement surfaces included within the admission cavities towards predefined housing grooves that cooperate with the admission cavities to keep the cables in a specified order, wherein the conductors of the twisted pair cable inserted in the admission cavities are surrounded by walls that define the corresponding admission cavity in which the conductors are inserted, wherein the admission cavities are distributed in three planes from a lower surface of the wire holder casing to an upper surface thereof; a bottom plane near the lower surface comprising a first central admission cavity for the conductors of a twisted pair of the twisted pair cable, an intermediate plane including two outside admission cavities for the conductors of a twisted pair of the twisted pair cable respectively, the two outside admission cavities being separated by the first central admission cavity of the lower plane; and an upper plane comprising a second central admission cavity for the conductors of one or two twisted pairs of the twisted pair cable, wherein each of the two outside admission cavities can only accept one twisted pair each of the twisted pair cable, the first central admission cavity can only accept one twisted pair of the twisted pair cable, and the second central admission cavity can accept one or two pairs of the twisted pair cable, wherein the flat base portion is integral with the wire holder casing and includes a set of conductor housing grooves extending from an end of the through admission cavities to the external contact face and configured to cooperate with the through admission cavities to support the conductors of the twisted pair cable in a predefined order, and wherein the first central admission cavity and the two outside admission cavities are arranged to abut with the flat base portion, and the second central admission cavity is arranged above the first central admission cavity and spaced apart from the flat base portion, the second central admission cavity having a width wider than a width of the first central admission cavity throughout the wire holder casing.

* * * * *